US005881427A

United States Patent [19]

Offner

[11] Patent Number: 5,881,427

[45] Date of Patent: Mar. 16, 1999

[54] SHOE-CLEANING ASSEMBLY

[76] Inventor: Johanna Offner, Nusswaldgasse 22, A-1190 Wein, Austria

[21] Appl. No.: 801,078

[22] Filed: Feb. 14, 1997

[30] Foreign Application Priority Data

Feb. 23, 1996 [AT] Austria ..... A 337/96

[51] Int. Cl.[6] ..... A47L 13/02

[52] U.S. Cl. ..... 15/215; 15/238; 15/104.92

[58] Field of Search ..... 15/104.92, 161, 15/215, 216, 217, 231, 238; 422/292, 300

[56] References Cited

U.S. PATENT DOCUMENTS

| | | | |
|---|---|---|---|
| 3,300,275 | 1/1967 | Lorman | 15/215 |
| 3,578,738 | 5/1971 | Hughes | 15/215 |
| 4,564,546 | 1/1986 | Jones | 15/215 |
| 5,018,235 | 5/1991 | Stamatiou | 15/215 |

FOREIGN PATENT DOCUMENTS

| | | | |
|---|---|---|---|
| 6-169876 | 6/1994 | Japan | 15/215 |

*Primary Examiner*—Terrence Till
*Attorney, Agent, or Firm*—Herbert Dubno

[57] ABSTRACT

A floor mat or grate overlain by a web or paper fabric is provided with a clamping device having at least one bar engaging the fabric for preventing shifting of the fabric on the grate or mat. The fabric can be removed, e.g. for cleaning or replacement, by releasing the clamping unit.

6 Claims, 4 Drawing Sheets

SHOE-CLEANING ASSEMBLY

FIELD OF THE INVENTION

My present invention relates to a shoe-cleaning assembly and, more particularly, to an assembly which can include or be used as a door mat or at an entrance-way or at other floor area at which a user can remove contaminants from his or her shoes.

BACKGROUND OF THE INVENTION

It is not uncommon at entrance ways to commercial and industrial establishments to provide grates or like structures with scraping units, brushes or the like for removing soil from the soles of the shoes of entrants to the establishment. Door mats of various types are widely used for domestic and commercial establishments to assist in removing soil from the shoes of residents or customers. All such systems are designed primarily to limit the extent of the contamination of the shoes of the user passing beyond the assembly and generally work best with dry soil. However, frequently it is desirable to remove finer contaminants, dust or moisture from the soles of the shoes of a user and in such cases it is not uncommon to provide a cloth or paper web on top of the grate or mat so that the user, by rubbing his or her shoes upon this web, can remove traces of contaminants which might otherwise remain adherent. The web can also be moistened, if desired, to improve the cleaning operation.

However, the application of a cloth or paper overlay for a grate or mat of the type described has had the drawback that the fabric tends to wrinkle up and move on the grate or mat and that paper web tends to shift or crease to the point that the mat or grate may be uncovered and the cleaning surface available for the soles of the shoes may be reduced.

OBJECTS OF THE INVENTION

It is, therefore, an object of the invention to provide an improved shoe-cleaning assembly whereby this drawback is avoided.

Another object of the invention is to provide an improved shoe-cleaning system in which a web of fabric or paper can be provided on the mat or grate, whereby removal of the web for washing or replacement is facilitated but the danger that the web will shift or crease or wrinkle will be reduced.

Another object is to provide an improved shoe-cleaning assembly with better esthetics prior to, during and after use.

SUMMARY OF THE INVENTION

These objects and others which will become apparent hereinafter are attained, in accordance with the invention, in a shoe-cleaning assembly in which the web of fabric or paper covering the grate or mat is held in place by a clamping device including at least one clamping bar which presses against the web and retains it against shifting on the mat or grate member.

In this case, by opening of the clamping device, the web can be removed for washing, cleaning or replacement. The clamping bar can clamp the web against the perimeter of the mat or grate member and, according to the invention, the bar can be swingable on a frame structure or on the member, can form part of a frame which is swingable relative to the mat or grate member, or can be part of a frame which is fitted over the mat or grate member.

The bar can be assembled with other bars or frame portions and readily disassembled therefrom for release of the web and further at least one releasable connecting element can be provided for the bar.

The web can be retained at a tear-edge and at least one further edge by the clamping device and fresh lengths of the web can be drawn from a supply and the spent portion of the web can be torn off along the tear edge. Furthermore, means can be provided for moistening the web with a solution, e.g. a disinfectant solution. The web can be provided with means whereby a used portion can be replaced by an unused portion of the web.

A shoe-cleaning device according to the invention can then comprise:

- a shoe-cleaning member disposed on a floor and having a surface on which soles of shoes can be rubbed to shed dirt therefrom;
- a web of replaceable material overlying the surface for wiping the soles; and
- releasable clamping means including at least one bar extending alongside the member for clamping the web against dislocation from the surface upon wiping of shoes thereon.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
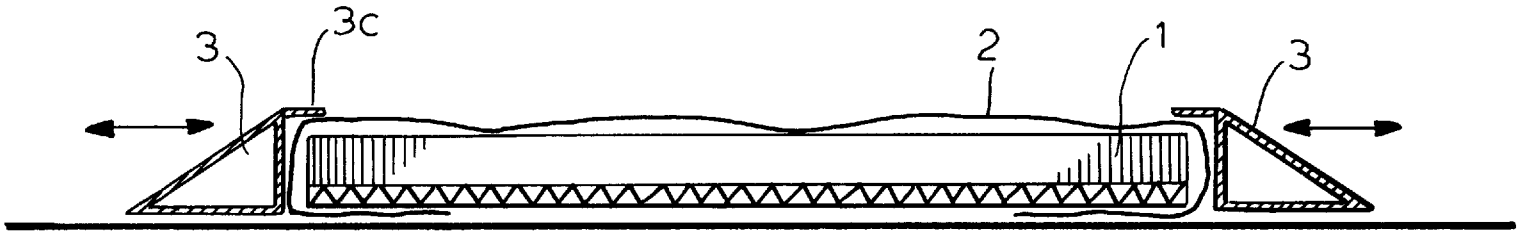
FIG. 1 is a cross sectional view through a first embodiment of the invention.

FIG. 1 shows an embodiment of a doormat assembly in which, above a floor mat 1, a floor cloth 2 is folded so as to partly underlie the floor mat which is received in a frame formed by bars 3 which have a triangular cross section and a flange 3*c* overhanging the mat 1 and the cloth layer 2 thereon.

Other bars, for example a bar 13, completes the frame with the bars 3 and lie behind the mat and in front of the mat as seen in FIG. 1. The bars 13 have the overhanging flange 13*c* corresponding to the flange 3*c* and are formed with projections 14 which engage in a snap-fit in the hollow bars 3. The result is that the bars are releasably connected into a frame which fits tightly around the periphery of the mat 1 to hold the cloth layer 2 thereon.

Figure 3:
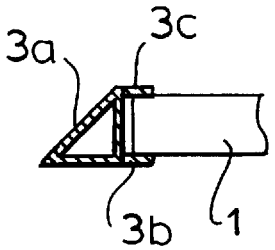
FIG. 3 is a diagrammatic cross sectional view illustrating a modification of the device of FIG. 1.

As has been shown in FIG. 3, the bars 3 can, as seen for the bar 3*a*, be formed with flanges 3*b* underlying the mat 1 to provide additional retention of the cloth layer 2 on the mat. The cloth layer can be a sanitizing carpet and can be impregnated with a disinfectant.

As has been shown in FIG. 1, the bars may be joined together in a frame 5 which may pivotally connect at 15 to the fixed frame 16 surrounding the grate 4 so as to clamp the fabric 2 thereon.

Upon swinging of the frame 5 down as represented by the dot-dash line 17, the fabric layer 2 is clamped against the grate 4.

Figure 4:
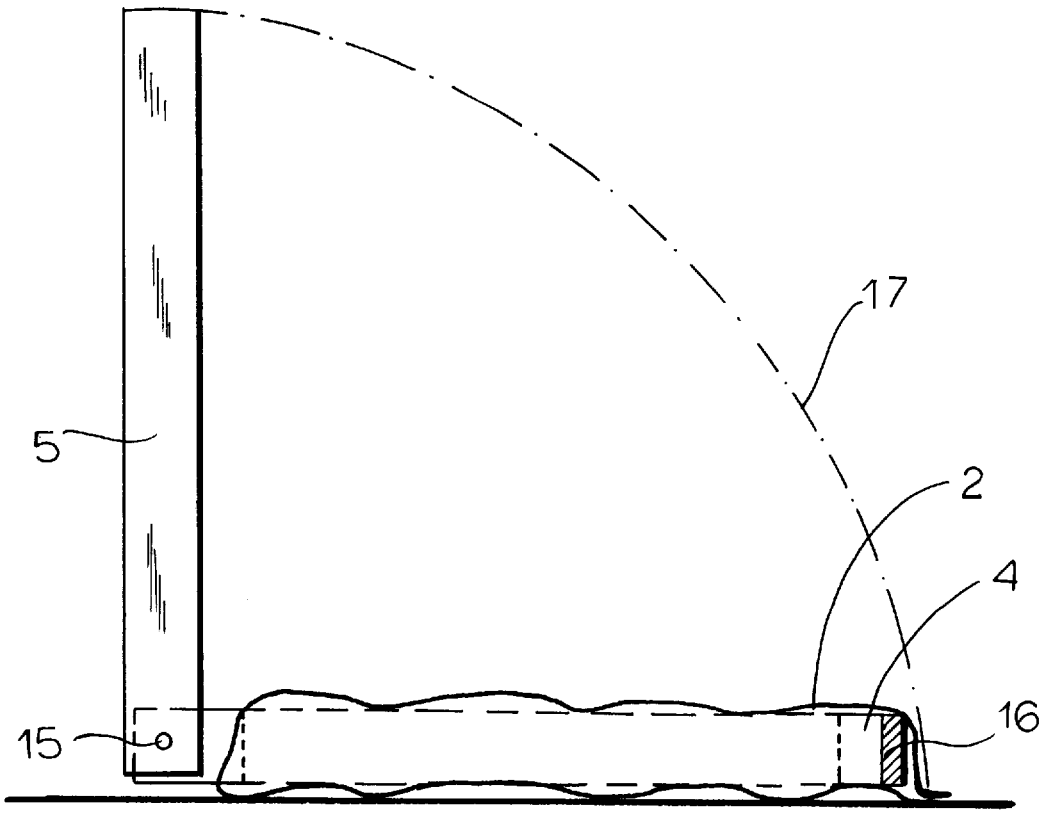
FIG. 4 is a side elevational view of a second embodiment of the invention with the clamping frame lifted into its upper position in which the floor cloth is removable.
Figure 4A:
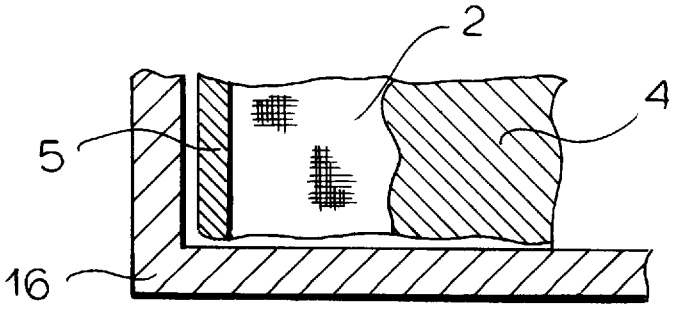
FIG. 4*a* is a top view of the embodiment seen in FIG. 4 and corresponding to the bar engaging the material against the grade.

FIG. 4*a* shows the bar 5 in its clamped position fitted between the stationary frame and the grate 4.

Figure 5:
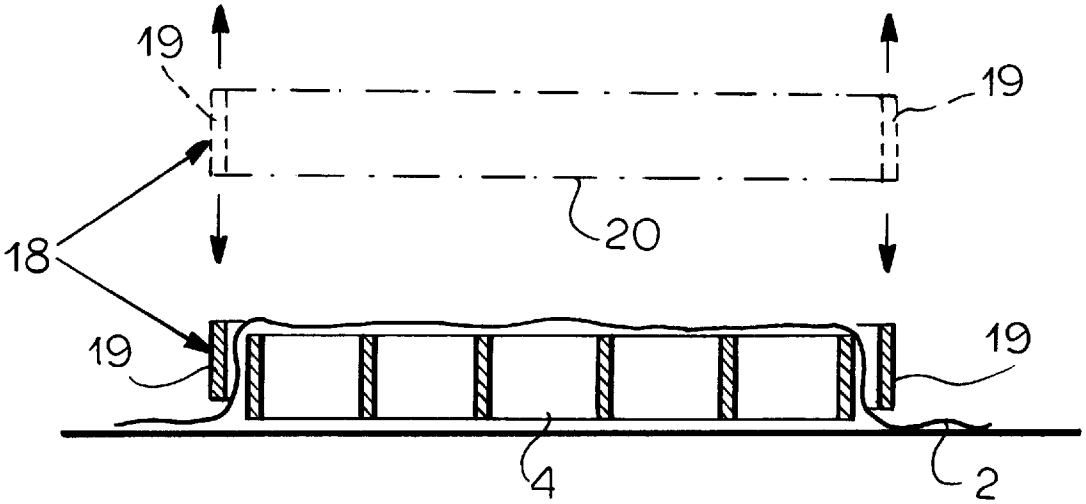
FIG. 5 is a cross sectional view showing another embodiment of the invention.
Figure 2:
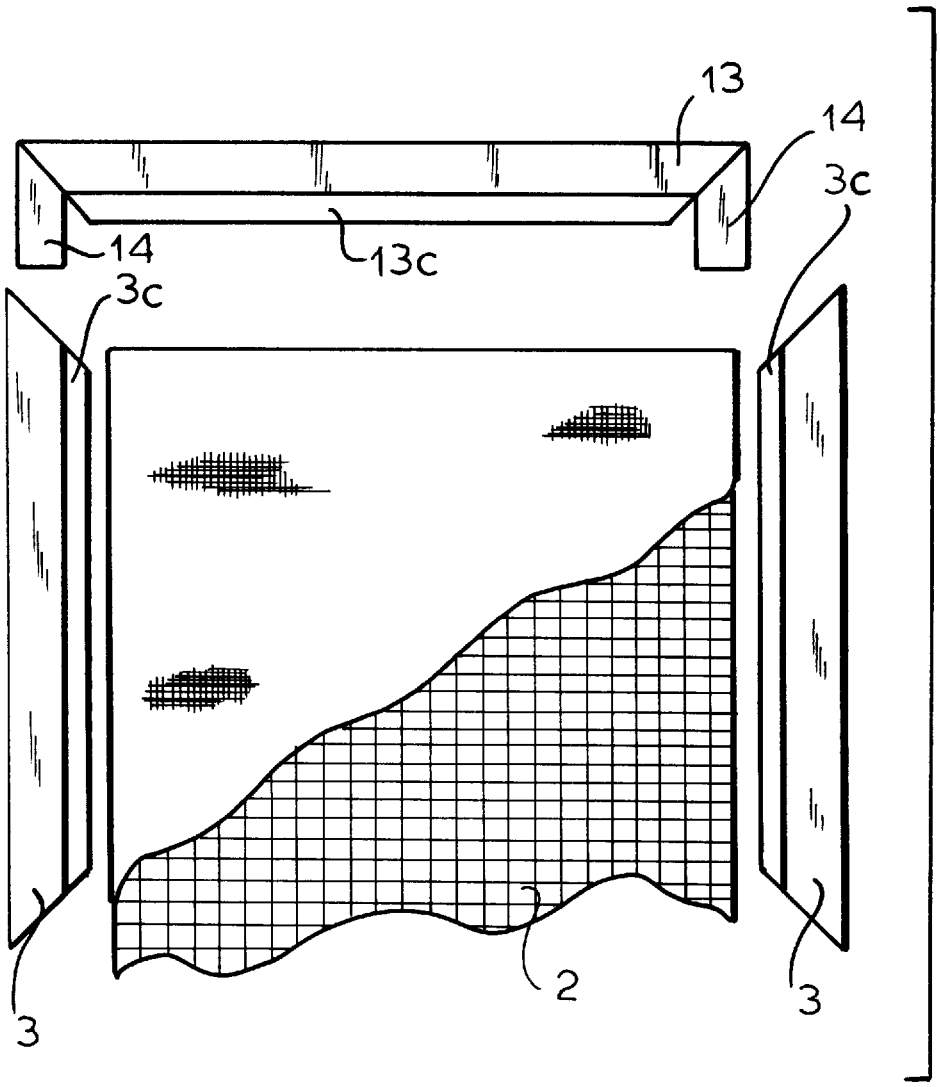
FIG. 2 is an exploded fragmentary plan view, partly broken away, showing the interconnection of the bars of the clamping frame for the system of FIG. 1.

FIG. 5 shows an embodiment in which the frame 18 composed of bars 19 and 19', for example, can be lifted and lowered to release and engage the cloth layer 2 on the grate 4. The fabric layer 2 can be a bibulous material such as a nonwoven fabric, a fleece, a foam or a porous mat capable of receiving contaminated soil or dust. Not shown here is a hand grip or an actuating device for automatic replacement of the fabric. The unit can be used in association with a tray or pan for supplying a disinfectant, means for cleaning the grate or means for cleaning the web which can increase the effectiveness of the system still further.

Figure 6:
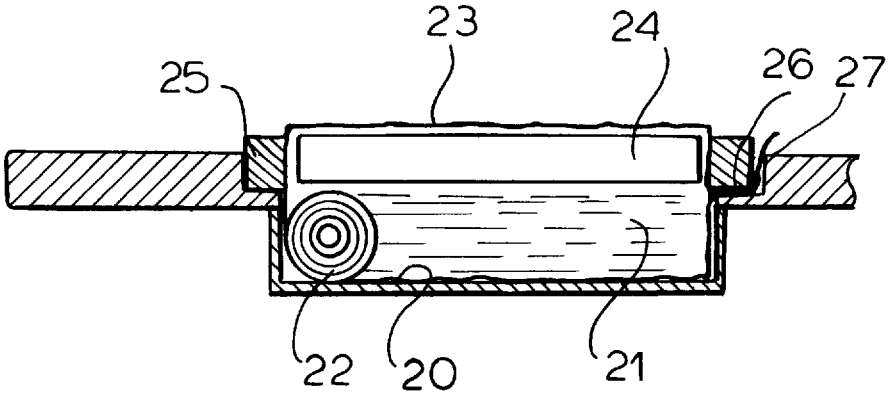
FIG. 6 is a diagrammatic cross-section showing a system for supplying additional lengths of the web.

In FIG. 6, for example, I show a pan or tray 20 containing liquid disinfectant 21 which permeates a roll 22 of the web 23 so that the latter, when drawn over the grate 24 is moistened with the disinfectant solution. A frame 25 as described clamps the layer 23 against the grate 24 and provides at 26 a tear edge at which a used portion of the fabric may be torn away at 27. When the frame 25 is lifted or disassembled, a fresh length of the web can be drawn from the supply 25 by a user.

Figure 7:
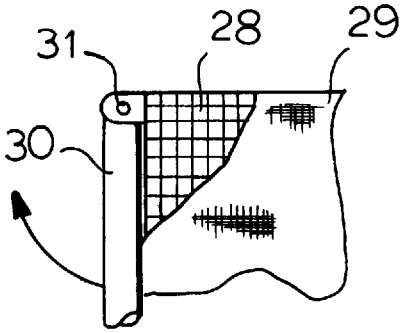
FIG. 7 is a diagrammatic plan view showing a portion of another assembly of the invention, also partly broken away.

In FIG. 7, I have shown a grate 28 partly covered by a floor cloth 29 and having a bar mounted pivotally on the grate about a vertical axis 31. The bar 30, swung inwardly as shown, clamps the fabric 19 against the grate 28.

I claim:

1. A shoe-cleaning floor device comprising:

shoe-cleaning member disposed on a floor and having a surface on which soles of shoes can be rubbed to shed dirt therefrom;

a web of replaceable material held at a tear edge and overlying said surface for wiping said soles; and releasable clamping means including at least one bar extending alongside said member for clamping another edge of said web against dislocation from said surface upon wiping of shoes thereon against said member.

2. The shoe-cleaning floor device defined in claim 1 wherein said member is a grate.

3. The shoe-cleaning floor device defined in claim 1 wherein said bar forms part of a frame fittable over and removable from said member for movement relative to said member between a clamped position retaining said web and a released position releasing said web for replacement.

4. The shoe-cleaning floor device defined in claim 1, further comprising means for moving said web to replace a used part by an unused part.

5. The shoe-cleaning floor device defined in claim 1 where in said web is a fabric.

6. The shoe-cleaning floor device defined in claim 1 where in said web is paper.

* * * * *